US011466342B1

(12) United States Patent
Boukhalfa et al.

(10) Patent No.: US 11,466,342 B1
(45) Date of Patent: Oct. 11, 2022

(54) SYSTEM AND METHOD EMBODIMENTS FOR ELEMENT EXTRACTION AND SEPARATION

(71) Applicant: Triad National Security, LLC, Los Alamos, NM (US)

(72) Inventors: Hakim Boukhalfa, Santa Fe, NM (US); Artaches Migdissov, Los Alamos, NM (US); Andrew Strzelecki, Pullman, WA (US); Robert Patrick Currier, Santa Fe, NM (US)

(73) Assignee: Triad National Security, LLC, Los Alamos, NM (US)

( * ) Notice: Subject to any disclaimer, the term of this patent is extended or adjusted under 35 U.S.C. 154(b) by 395 days.

(21) Appl. No.: 16/549,641

(22) Filed: Aug. 23, 2019

Related U.S. Application Data

(60) Provisional application No. 62/859,428, filed on Jun. 10, 2019.

(51) Int. Cl.
*C22B 59/00* (2006.01)

(52) U.S. Cl.
CPC ..... *C22B 59/00* (2013.01)

(58) Field of Classification Search
CPC ..... C22B 59/00; C22B 7/00; C22B 7/006; C22B 7/007
USPC ..... 75/712
See application file for complete search history.

(56) References Cited

U.S. PATENT DOCUMENTS

2014/0283652 A1* 9/2014 Sugita ..... C22B 3/3844 75/743
2016/0346736 A1* 12/2016 Bhave ..... B01D 69/08

OTHER PUBLICATIONS

A. V. Anufrieva et al. Rare Earth Elements Materials Production from Apatite Ores, (2016) IOP Conf. Series: Material Science and Engineering 112 (Year: 2016).*

Papangelakis et al., "Recovery of rare earth elements from clay minerals," *ERES2014: 1st European Rate Earth Resources Conference*, Apr. 7-Apr. 9, 2014, pp. 191-202.

* cited by examiner

*Primary Examiner* — Brian D Walck
*Assistant Examiner* — Danielle Carda
(74) *Attorney, Agent, or Firm* — Klarquist Sparkman, LLP

(57) ABSTRACT

The present disclosure provides system and method embodiments for extracting and separating rare earth elements (REEs) from various starting materials and sources. The system and method embodiments disclosed herein facilitate efficient REE extraction, separation, and/or isolation, even when the REEs are present in a starting material at a relatively low level compared to undesirable metals co-present in the starting material. In at least some examples, the disclosed system and method embodiments may be used to recover one or more REEs from coal derived acid mine drainage.

14 Claims, 12 Drawing Sheets

SYSTEM AND METHOD EMBODIMENTS FOR ELEMENT EXTRACTION AND SEPARATION

CROSS REFERENCE TO RELATED APPLICATION

This application claims priority to U.S. Provisional Application No. 62/859,428, filed Jun. 10, 2019, which is incorporated herein by reference in its entirety.

ACKNOWLEDGMENT OF GOVERNMENT SUPPORT

This invention was made with government support under Contract No. 89233218CNA000001 awarded by the U.S. Department of Energy/National Nuclear Security Administration. The government has certain rights in the invention.

FIELD

The present disclosure is directed to system embodiments and methods for separating and/or isolating rare earth elements.

BACKGROUND

Demand for rare earth elements (REEs) and other critical materials has increased over the years, particularly due to the use of such materials in a variety of applications, such as low-carbon technologies; producing high-performance magnets, catalysts, alloys, glasses, electronics, and the like; and electric motors for hybrid vehicles, wind turbines, hard disc drives, portable electronics, microphones, speakers, and the like.

Limited techniques exist for extracting and separating REEs. One technique involves extracting an ore including REEs, and crushing and milling the ore to generate small rock particles. The small rock particles are subjected to a froth flotation process that mixes the small rock particles with water and reagents, resulting in a liquid mixture. The liquid mixture undergoes air pumping, during which platinum group metal (PGM)-containing particles adhere to bubbles and float. The floating PGM-containing particles thereafter undergo drying and smelting in an electrical furnace. As a result of this drying and smelting, unwanted minerals are discarded and a metal matte (including REEs) is obtained. The metal matte is subjected to periodical tapping using oxygen blowing in converters, which isolates iron and sulfur from a converter matte (including REEs). The converter matter is then subject to standard electrolytic metal refining, which allows REEs to be isolated. This technique (along with others), however, is ineffective in isolating REEs due to the low level of REEs compared to undesirable metals co-present in the starting materials used in such techniques.

There exists a need in the art for system and method embodiments that enable critical material extraction, separation, and/or isolation (and particularly REEs), from a variety of starting materials/sources, particularly those that have low levels of critical materials as compared other elements compounds present in the starting materials/sources.

SUMMARY

Disclosed herein are embodiments of a system for extracting elements, such as REEs from sources. In some embodiments, the system comprises a flow-through container structure having a hollow interior, wherein the flow-through container structure is configured to allow a fluid comprising one or more rare earth elements (REEs) to flow through the flow-through container structure; an extractant material comprising phosphate ions, or fluoride ions, or a combination of phosphate ions and fluoride ions, wherein the extractant material is positioned within the hollow interior of the flow-through container structure; and a heating element associated with the flow-through container structure, wherein the heating element is configured to provide an elevated temperature environment. In some embodiments, the system further comprises a fluid comprising the one or more REEs. Various system embodiments are disclosed in more detail herein.

Also disclosed herein are embodiments of a method for using the system. In some embodiments, the method comprises providing a system comprising (i) a container structure having a hollow interior, wherein the container structure is configured to allow a fluid comprising one or more rare earth elements (REEs) to flow through the container structure; (ii) an extractant material comprising phosphate ions, or fluoride ions, or a combination of phosphate ions and fluoride ions, wherein the extractant material is positioned within the hollow interior of the container structure; and (iii) a heating element associated with the container structure, wherein the heating element is configured to provide an elevated temperature environment; introducing a fluid comprising one or more REEs into the system; heating the container structure, the extractant material, the fluid, or any combination thereof using the heating element; and passing the fluid through the container structure. In some embodiments, the method can further comprise producing the fluid from an ore comprising the at least one REE, a concentrate comprising the at least one REE, fly ash comprising the at least one REE, or any combination thereof. In yet additional embodiments, the method can further comprise modifying a flow rate of the fluid to facilitate REE extraction and/or establishing thermal gradients to facilitate REE extraction.

The foregoing and other objects and features of the present disclosure will become more apparent from the following detailed description, which proceeds with reference to the accompanying figures.

DETAILED DESCRIPTION

I. Overview of Terms and Abbreviations

Figure 1A:
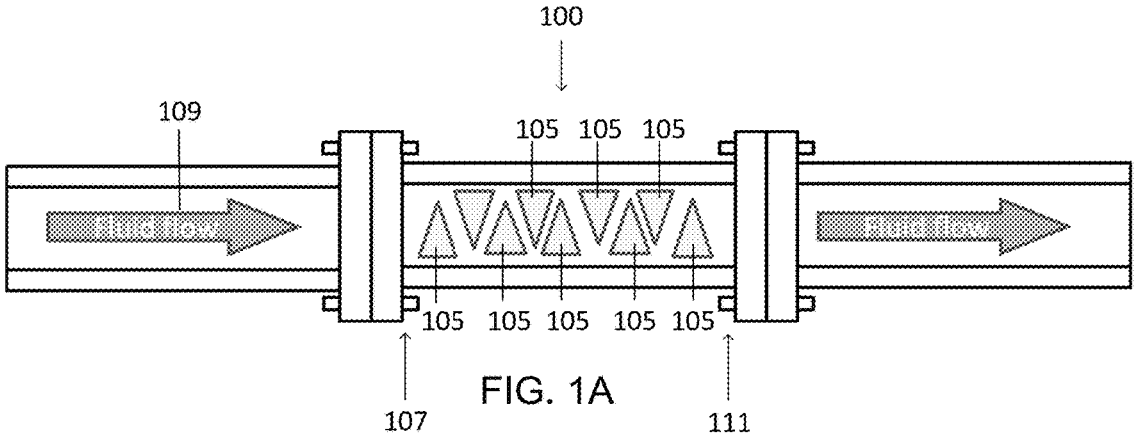
FIG. 1A is a schematic representation of a representative system embodiment comprising a flow-through container structure and an extractant material contained therein for extracting and separating critical materials, such as REEs.

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims, are to be understood as being modified by the term "about." Accordingly, unless otherwise indicated, implicitly or explicitly, the numerical parameters set forth are approximations that can depend on the desired properties sought and/or limits of detection under standard test conditions/methods.

Also, the following description is exemplary in nature and is not intended to limit the scope, applicability, or configuration of the present disclosure. Various changes to the described embodiment may be made in the function and arrangement of the elements described herein without departing from the scope of the preset disclosure. Further, descriptions and disclosures provided in association with one particular embodiment are not limited to that embodiment, and may be applied to any embodiment disclosed. Further, the terms "coupled" and "associated" generally mean fluidly, electrically, and/or physically (e.g., mechanically or chemically) coupled or linked and does not exclude the presence of intermediate elements between the coupled or associated items absent specific contrary language.

Although the operations of exemplary embodiments of the disclosed method and/or system embodiments may be described in a particular, sequential order for convenient presentation, it should be understood that disclosed embodiments can encompass an order of operations other than the particular, sequential order disclosed, unless the context dictates otherwise. For example, operations described sequentially may in some cases be rearranged or performed concurrently. Further, descriptions and disclosures provided in association with one particular embodiment are not limited to that embodiment, and may be applied to any disclosed embodiment.

To facilitate review of the various embodiments of the disclosure, the following explanations of specific terms are provided.

Extractant Material: A material capable of associating with an REE (or an ion thereof), such as by binding the REE (or the ion thereof). In some embodiments, the extractant material is a solid. Exemplary extractant material embodiments are disclosed herein.

Electrically Coupled: This term is used in reference to how a heating element can be associated with a system embodiment disclosed herein, such as a flow-through container structure. In embodiments where the system (e.g., flow-through container structure) is electrically coupled to the heating element, the heating element typically is attached to the flow-through container structure, or other component of the system, via wiring and/or connectors.

Elevated Temperature: A temperature above ambient temperature. In some embodiments, elevated temperatures include temperatures above 50° C., such as above 100° C., or above 150° C., or above 200° C., or above 250° C. In some embodiments, elevated temperatures can be temperatures ranging from greater than ambient temperature to 500° C., such as 100° C. to 450° C., or 100° C. to 400° C., or 150° C. to 350° C., or 200° C. to 300° C.

Flow-Through Container Structure: A structure having a hollow interior capable of housing an extractant material and configured to allow a fluid to flow into and out of its interior. The flow-through container structure can be any suitable shape as long as it comprises an opening and/or an inlet into which fluid can be introduced into its interior and an opening and/or an outlet from which fluid can be expelled from its interior. In some embodiments, the flow-through container structure is a tubular structure provided in a tubular configuration and can comprise a coiled or linear arrangement. In some embodiments, the flow-through container structure is a reactor suitable for extraction techniques.

Heating Element: A component that can be associated with a system embodiment and that is configured to provide an elevated temperature such that the system embodiment is operated at a particular temperature and/or such that a flow-through container structure, an extractant material, and/or a fluid introduced into the flow-through container structure is able to reach an elevated temperature (which can be the same or different as the elevated temperature of the heating element).

Heating Source: A heating source, other than a heating element, that can be used to provide high temperatures used to raise the temperature of a system embodiment during operation. In some embodiments, the heating source can be a fossil fuel source, a source of heat provided by combusting organic matter, a geothermal source, a nuclear source, and/or a concentrated solar energy source.

Heavy-Group Rare Earth Element (or HREE): A classification for an REE based on the electron configuration of the rare-earth element. Representative HREEs include terbium, atomic number 65, through lutetium, atomic number 71, and combinations thereof. In some embodiments, yttrium, atomic number 39, is an HREE. HREEs are different from LREEs in that HREEs have paired electrons.

Light-Group Rare Earth Element (or LREE): A classification for an REE based on the electron configuration of the rare-earth element. Representative LREEs include lanthanum, atomic number 57, through gadolinium, atomic number 64, and combinations thereof. LREEs comprise increasing unpaired electrons.

Physically Associated: This term is used in reference to how a heating element can be associated with a system embodiment disclosed herein, such as a flow-through container structure. In embodiments where the system (e.g., flow-through container structure) is physically associated with the heating element, at least a portion of the system (such as at least a portion of the flow-through container structure) is in contact with, immersed in, wrapped in, and/or otherwise completely or partially surrounded by the heating element.

Rare Earth Element (or "rare earth elements," "REE," or "REEs"): An element selected from cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), terbium (Tb), thulium (Tm), and ytterbium (Yb); and, in some embodiments, scandium (Sc) and yttrium (Y).

II. System and Method Embodiments

Disclosed herein are system and method embodiments for extracting and separating rare earth elements (REEs) from various starting materials and sources. In some embodiments, an REE may be characterized as light or heavy. In some embodiments, light REEs can include La, Ce, Pr, Nd, Sm, and alloys thereof. In some embodiments, heavy REEs can include Gd, Tb, Dy, Er, Y, (and in some embodiments, Sc), and alloys including a combination of such REEs. In at least some economies, light REEs may be economically less valuable than heavy REEs. Based at least in part on this, at least some techniques of the present disclosure may be configured to extract and separate heavy REEs from light REEs and/or other components contained with the starting/source material. However, the disclosed method and system embodiments also can be used to isolate light REEs.

At least some extraction and separation techniques of the present disclosure are configured based on the following principles: (1) REE-containing phosphates and fluorides have rather low solubility in aqueous media; (2) trace amounts of fluoride ($F^-$) and phosphate ($PO_4^{3-}$) can lead to REE precipitation; (3) solubilities of REE-containing phosphates and fluorides are significantly lower and more preferential than solubilities of co-present elements, such as iron, aluminum, and other transition metals, sodium, potassium, and calcium; and (4) solubilities of REEs-containing phosphates and fluorides are retrograde and thus can decrease with increasing temperature.

Described herein are embodiments of a system for extracting and separating REEs from a mixture. In particular embodiments, the system can comprise flow-through container structure embodiments for extracting and separating REEs from a mixture, moving bed reactor embodiments for extracting and separating REEs from a mixture, and/or fluidized bed reactor embodiments for extracting and separating REEs from a mixture. Such embodiments are discussed herein.

In some embodiments, the system comprises a flow-through container structure that is configured to house an extractant material. The flow-through container structure also is configured to allow a fluid to flow through an interior of the flow-through container structure, such as an interior that houses the extractant material. In some embodiments, the flow-through container structure can comprise a first end having an opening or an inlet fluidly coupled to the flow-through container structure such that fluid can be introduced into the interior of the flow-through container structure; and a second end having an opening or an outlet fluidly coupled to the flow-through container structure such that fluid can be expelled from the interior of the flow-through container structure. In some embodiments, the flow-through container structure can have a tubular structure having a particular length and interior volume. In particular disclosed embodiments, the flow-through container structure can be a column, such as a flow-through column (e.g., a tubular column, a coiled column, or a linear column) or any other such column suitable for separating chemical species. In yet additional embodiments, the flow-through container structure can be a reactor, such as a moving bed reactor, a fluidized bed reactor, or the like. Exemplary flow-through container structures can include, but are not limited to, flow-through container structures made of titanium, stainless steel, monel high pressure materials (e.g., acid resistant nickel alloys), and other similar materials and alloys thereof. In some such embodiments, the flow-through container structure can further comprise a porous plate contained within the interior of the flow-through container structure. Also, such flow-through container structure embodiments can comprise a lower region and a top region. Exemplary flow-through container structure embodiments are described herein.

The system embodiment also may comprise an extractant material housed in the flow-through container structure. In some embodiments, the extractant material can comprise a material having negatively charged ions. In some embodiments, the extractant material is a solid material and can be porous, granular, in the form of particles or other shapes, amorphous, crystalline, or any combination thereof. In some embodiments, a single extractant material can be used and in other embodiments a mixture of different extractant materials can be used. In some embodiments, the extractant material can comprise phosphate polyatomic ions ($PO_4^{3-}$) and/or fluoride ions ($F^-$). In some embodiments, the extractant material can comprise apatite group minerals, such as minerals comprising calcium phosphate and some fluoride ions ($F^-$), chloride ions ($Cl^-$), bromide ions (Br), hydroxide ions ($OH^-$) and other elements and/or ions. Such apatite group minerals can have a formula $Ca_5(PO_4)_3(X)$, wherein X is $F^-$, $Cl^-$, $Br^-$, or $OH^-$. In some particular embodiments, the extractant material can comprise a fluoroapatite material (e.g., $Ca_5(PO_4)_3F$), which provides phosphate ions and fluoride ions. In yet additional embodiments, the extractant material may comprise non-crystalline biological apatite (e.g., bone material, bone char, and the like). In yet some additional embodiments, the extractant material can comprise a fluorite material, such as the mineral form of calcium fluoride ($CaF_2$). Other extractant materials that can be used for the extractant material contained in the flow-through container structure can include, but are not limited to, fluorcarmoite-(BaNa), fluororichterite, fluorwavellite, frankdicksonite, and the like.

As described above, in some embodiments, extractant material contained in the flow-through container structure may comprise phosphate ions and/or fluoride ions. The phosphate polyatomic ion carries a −3 charge, a fluoride ion carries a −1 charge, and REEs are positively charged. As such, one or more REEs may be extracted from the fluid through ion exchange. For example, as the fluid passes through the extractant material contained within the flow-through container structure, positively charged REEs may be extracted from the fluid introduced into the system due to interactions between the positively charged REEs binding to the negatively charged ions in the extractant material contained in the system (e.g., such as binding ionically, covalently, or through dipole-dipole interactions, van der Waals forces, or the like). As a result, any positively charged ions of the extractant material may be displaced by the REE. In other words, the positively charged REEs may exchange with positively charged ions bound to the negatively charged ions in the extractant material, and the positively charged ions may be expelled from the flow-through container structure in the effluent that flows through the system.

In some embodiments, the system can further comprise a fluid, which can contain one or more REEs. The fluid can be a starting material or source material solution. In particular embodiments, a fluid comprising one or more REEs can be introduced into the system for REE extraction/separation. The fluid passes through the flow-through container structure along a flow path and is allowed to also pass through any extractant material contained therein. In some embodiments, the fluid may be any acidic aqueous media containing one or more REEs. The pH of the acidic aqueous media may vary, and typically can range from pH=1.5 to weakly acidic up to pH=3.5. In yet additional embodiments, the REEs can be complexed by organic ligands and a fluid comprising such complexes can be passed through the system. Any classes of organic ligands that can maintain REEs in solution at a pH greater than 3.5 to prevent hydrolysis, but which are not stable at elevated temperature, may be used in accordance with the present disclosure. Some representative (but non-limiting) examples of organic ligands can include ethylenediaminetetraacetic acid (EDTA), diethylenetriamine pentaacetic acid (DTPA), citrate, and the like.

The fluid may be generated from various REE-containing starting materials and/or sources. Examples of REE-containing materials that may be suspended in or dissolved in a fluid solution to be passed through the system can include, but are not limited to, REE ores and any concentrates thereof (e.g., artificially enriched REE ores, such as HREE-enriched monazite sands), acid mine drainage fluids and sludge, sludge from water treatment facilities, mine tailings, coal and coal combustion products, and fly ash, which is ash produced in small dark flecks, typically from a furnace, and capable of being carried into the air. In some embodiments, the fluid comprising one or more REEs can be generated from a starting material or source by alkaline roasting of REE-containing minerals, followed by acid leaching; direct acid leaching for ore and coal derived materials; acidification for acid mine sludge; as-is acid mine drainage solutions; and any combination thereof. These are representative examples and are not intended to be limiting. The source water may be subjected to pretreatment, or preconditioning, or other water treatment prior to being used in the disclosed system and method embodiments.

In yet additional embodiments, multiple system embodiments described herein can be used to extract and/or isolate REEs. For example, multiple different system embodiments can be used in any combination, such as in a multi-stage system. In some exemplary embodiments, any combination of two or more of a flow-through container structure, a moving bed reactor, and a fluidized bed reactor can be used. In yet additional embodiments, a plurality of any single type of system can be used (e.g., a plurality of flow-through container structures, moving bed reactors, or fluidized bed reactors can be used). In embodiments comprising a plurality and/or combination of system embodiments, the individual systems can be fluidly coupled in series, in parallel, or a combination thereof. In some embodiments, each system embodiment can comprise the same or different extractant material contained in the system and/or can be heated at the same or different temperatures when using a hydrothermal process embodiment.

Also, individual system embodiments and/or multi-stage system embodiments as described herein can further comprise one or more additional components for facilitating system use. In some embodiments, such additional components can be selected from one or more heating sources or heating elements to maintain and control temperatures (e.g., to provide elevated temperatures), one or more heat exchanges to provide efficient energy utilization, one or more partial water recycling flow paths to facilitate REE removal from the system embodiments, one or more assorted valves to control fluid flow, one or more sensors for evaluating flow rate, pressures, or the like, one or more controllers to control fluid introduction or other system operations, one or more pumps and/or back flow regulators to facilitate fluid flow, or any combinations thereof. In some embodiments, the heating element is a heating coil or a heating medium and the heating element is physically associating with the flow-through container structure such that it surrounds at least a portion of the flow-through container structure (such as with the heating coil) or such that the flow-through container structure is immersed in the heating element (such as where the heating element is a heating medium, such as a solid or liquid that provides elevated temperatures). In yet some additional embodiments, a heating source can be used to provide high temperatures used to raise the temperature of the system during the method. In such embodiments, the heating source can be a fossil fuel source, a source of heat provided by combusting organic matter, geothermal sources, nuclear sources, and/or from concentrated solar energy.

Also disclosed herein are method embodiments for using the system embodiments described herein. In some embodiments, the method comprises providing a system embodiment comprising a flow-through container structure and an extractant material, introducing a fluid, such as a fluid comprising one or more REEs, into the system, and passing the fluid through the system. In some embodiments, the method can further comprise heating the system at an elevated temperature. In yet additional embodiments, the method can further comprise isolating REEs (or complexes containing REEs) from the flow-through container structure. In such embodiments, the REEs (or complexes thereof) can be isolated by chemical, thermal, or mechanical means, or any combination thereof.

In at least some method embodiments, REEs of different weights may bind to the negatively charged ions of the extractant material contained in the system at different rates. For example, light REEs may bind to the negatively charged ions in the extractant material at a faster rate than heavy REEs. As a result, light REEs may bind to the extractant material earlier during the method than heavy REEs and also at a location within the flow-through container structure proximal to the region wherein the fluid is introduced, whereas heavy REEs can be bound at locations distal from the region wherein the fluid is introduced.

In some method and system embodiments, positively charged REEs may experience temporary interactions with the extractant material contained in the system, but such temporary interactions may not result in binding the REE to the extractant material with a strength sufficient to extract the REE from the fluid. This can be particularly true for heavier REEs. In some embodiments, as a positively charged REE flows through the flow-through container structure, the speed at which the positively charged REE moves along the flow path of the fluid may decrease with each temporary interaction between the positively charged REE and different negatively charged ions of the extractant material. Assuming a constant flow rate, heavier REEs may experience more of these temporary interactions, which can slow the flow rate of the REE such that the positively charged REE may bind to (rather than temporarily interact with) a negatively charged ion(s) in the extractant material. This is due at least in part to heavier REEs having greater momentum than lighter REEs assuming they are undergoing the same flow rate.

The foregoing graduated separation of REEs may, in at least some examples, be a result of a flow rate of the fluid. For example, the faster the flow rate of the fluid, the more temporary interactions that may need to occur between a positively charged REE and negatively charged ions in the extractant material to decrease the flow speed of the REE sufficiently to enable the REE to bind to a negatively charged ion(s) in the extractant material. Accordingly, in some embodiments, fast flow rates of the fluid can result in greater distances between bands/regions of extracted REEs of different weights associated with the extractant material, and slow flow rates of the fluid can result in shorter distances between bands/regions of extracted REEs of different weights. In some embodiments, the amount of extractant material housed in the flow-through container structure can be increased so as to provide more of the extractant material along longer lengths of the flow-through container structure and/or the length (and/or the width) of the flow-through container structure itself can be increased to accommodate for faster flow rates and/or to facilitate separating heavy REES.

In yet some additional embodiments, the fluid may be subjected to a hydrothermal process of varying temperature as the fluid passes through the system. In at least some examples, the exchange rate of REE(s) with positively charged ions of the extractant material contained in the system may increase as the temperature of the fluid is increased.

While exemplary embodiments described herein can extract REEs using a hydrothermal process at 225° C., other temperatures can be used in the hydrothermal process embodiments described herein. In some embodiments, the hydrothermal process can comprise using temperatures above ambient temperatures to facilitate extracting REEs from fluid. For example, temperatures above 50° C., such as above 100° C., or above 150° C., or above 200° C., or above 250° C. can be used. In some embodiments, elevated temperatures can be temperatures ranging from greater than ambient temperature to 500° C., such as 100° C. to 450° C., or 100° C. to 400° C., or 150° C. to 350° C., or 200° C. to 300° C. In representative embodiments, the elevated temperature is 450° C., 400° C., 350° C., 300° C., 250° C., or 200° C. In some embodiments, the temperature can be held at a constant temperature as fluid flows through the system. In yet additional embodiments, gradient temperatures can be used, wherein the temperature is gradually increased or decreased as fluid flows through the system. In such embodiments, the temperature can be gradually increased from above room temperature to 500° C., such as 100° C. to 450° C., or 100° C. to 400° C., or 150° C. to 350° C., or 200° C. to 300° C. Modifying the temperature of the hydrothermal process embodiments can increase elemental extraction. For example, REEs can exhibit different solubilities depending on a surrounding temperature. As such, the system can be heated at an elevated temperature (such as temperatures as described above) to thereby influence REE solubility in the fluid and thus modify REE extraction from the fluid. In some embodiments, light REE fluoride complexes are more stable than the medium and heavy REEs. As such light REE may accumulate early in the process and the medium with heavy REEs may accumulate in the later stages of the reactors. Relative stability may be temperature dependent and so the temperature, or temperature gradient, may be manipulated as described above to enhance REE accumulation in specific portions of the process.

Figure 1B:
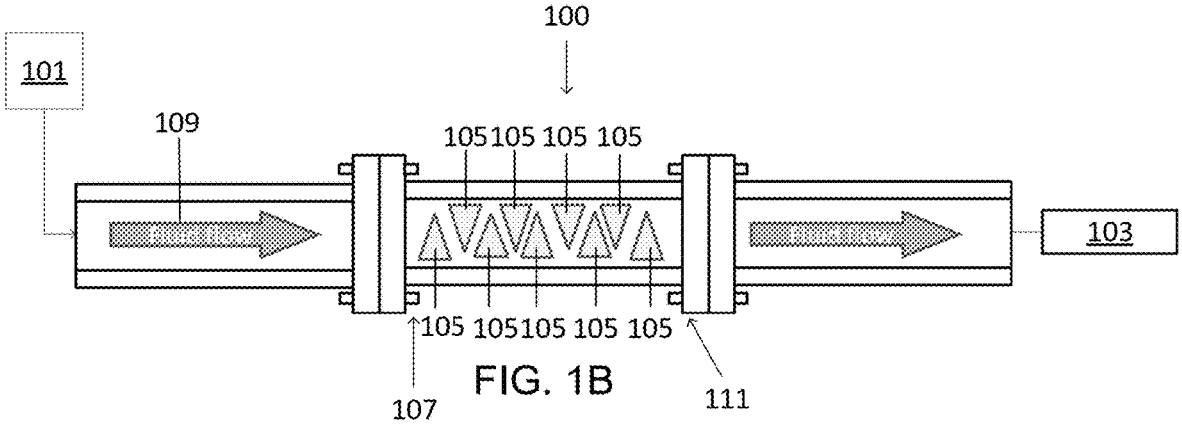
FIG. 1B is a schematic representation of a representative system embodiment comprising a flow-through container structure and an extractant material contained therein, and further comprising a pump and back pressure regulator.

In an exemplary method for extracting and separating REEs, a system comprising a tubular flow-through container structure is used. Exemplary tubular flow-through container structure embodiments are illustrated in FIGS. 1A and 1B (tubular flow-through container structure 100). With reference to FIG. 1A, tubular flow-through container structure 100 can be a commercially available high performance liquid chromatography (HPLC) column. In some embodiments, the tubular flow-through container structure can be fluidly coupled to a pump to facilitate flowing fluid through the tubular flow-through container structure. For example, in FIG. 1B, tubular flow-through container structure 100 is an HPLC column and is fluidly coupled to a commercially available HPLC pump 101. In yet additional embodiments, a back pressure regulator may be implemented downstream of (with respect to fluid flow) the tubular flow-through container structure. An exemplary embodiment is shown in FIG. 1B, wherein tubular flow-through container structure 100 is fluidly coupled to back pressure regulator 103.

As described herein, a system embodiment, such as a flow-through container structure, may comprise an extractant material comprising negatively charged ions. For example, as illustrated in FIGS. 1A and 1B, tubular flow-through container structure 100 can be configured to house one or more extractant materials 105 containing negatively charged ions. The fluid may flow through the extractant material contained in the flow-through container structure (e.g., extractant material 105, as illustrated in FIGS. 1A and 1B) along a flow path that extends from one end of the flow-through container structure to another end of the flow-through container structure. In some embodiments, fluid can flow in a direction that is parallel to gravitational forces (e.g., along with or opposite of any gravitational forces) or in a direction that is orthogonal to gravitational forces. In at least some examples, the fluid may flow through the extractant material contained in the flow-through container structure in the direction (or substantially in the direction) of gravity. As the fluid flows through the extractant material contained in the flow-through container structure, one or more REEs may be extracted from the fluid and adsorbed or otherwise associated with the extractant material contained in the flow-through container structure, while undesired co-present materials in the fluid (e.g., transition metals and alkaline earth metals) are not extracted from the fluid. As a result, the undesired co-present materials may remain in discarded effluent that passes through and exits the flow-through container structure. The flow may result from gravity alone or the flow may result from an imposed pressure gradient, such as an imposed pressure gradient established by using a pump.

As described herein, REEs of different weights may bind to the negatively charged ions of the extractant material contained in the flow-through container structure at different rates. For example, with reference to FIGS. 1A and 1B, the lightest REE in the fluid may bind to extractant material 105 first. That is, it may bind to extractant material that is located closest to proximal end 107 of tubular flow-through container structure 100, which is proximal to the region where the fluid is introduced, and heavier REEs will bind to extractant material 105 further down the length of the tubular flow-through container structure and along fluid flow path 109, such as near distal end 111 of the tubular flow-through container structure, which is distal to the region where the fluid is introduced. Thus, as the fluid flows along flow path 109, REEs of increasing weight may bind to extractant material 105 at particular regions along the flow path as the fluid flows from proximal end 107 to distal end 111. As a result, discrete separation bands/regions of REEs of different weights in extractant material 105 can be obtained. Also, as described herein, positively charged REEs may experience temporary interactions with the extractant material contained in the flow-through container structure, but such temporary interactions may not result in binding the REE to the extractant material with a strength sufficient to extract the REE from the fluid. The foregoing graduated separation of REEs may, in at least some examples, be a result of a flow rate of the fluid. In some embodiments, the amount of extractant material contained in the flow-through container structure can be increased so as to provide more of the extractant material along longer lengths of the flow-through container structure and/or the length (and/or the width) of the flow-through container structure itself can be increased to accommodate for faster flow rates and/or to facilitate separating heavy REEs.

Figure 2:
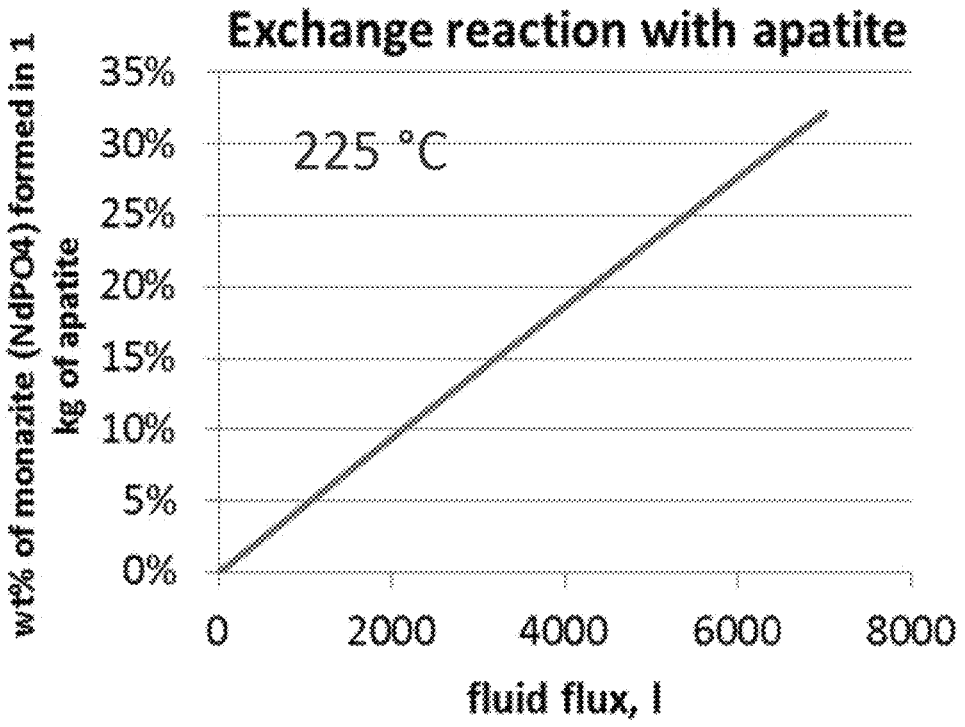
FIG. 2 is a graph illustrating wt % of monazite ($NdPO_4$) formed in 1 kg of apatite using a hydrothermal process embodiment at 225° C.
Figure 3:
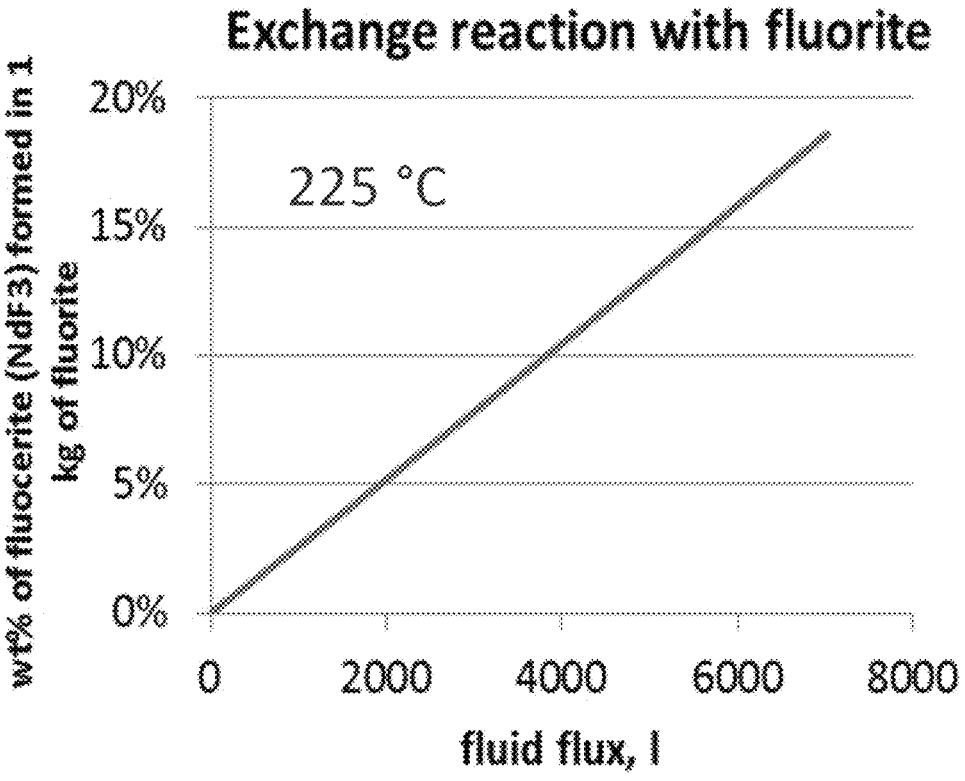
FIG. 3 is a graph illustrating wt % of fluocerite ($NdF_3$) formed in 1 kg of fluorite using a hydrothermal process embodiment at 225° C.

As discussed herein, the method can comprise a hydrothermal process. In at least some examples (e.g., embodiments using a flow-through container structure), the exchange rate of REE(s) with positively charged ions of the extractant material contained in the flow-through container structure may increase as the temperature of the fluid is increased. Solely by way of example, FIG. 2 shows the wt % of monazite ($NdPO_4$) formed in 1 kg of apatite at elevated temperatures (e.g., 225° C.). In this exemplary embodiment, 1 kg of apatite was interacted with a solution comprising 250 ppb Nd from coal-mine discharge. Assuming a daily flux of 4,000 gal (about 15,000 L), FIG. 2 demonstrates that about 7,150 g of REE phosphate (monazite) may be produced daily. In yet another example, FIG. 3 shows the wt % of fluocerite ($NdF_3$) formed in 1 kg of fluorite at elevated temperature (e.g., 225° C.). 1 kg of fluorite was interacted with a solution comprising 250 ppb Nd from coal-mine discharge. Assuming a daily flux of 4,000 gal (about 15,000 L), FIG. 3 demonstrates that about 3,850 g of REE fluoride (fluocerite) may be produced daily.

Figure 4:
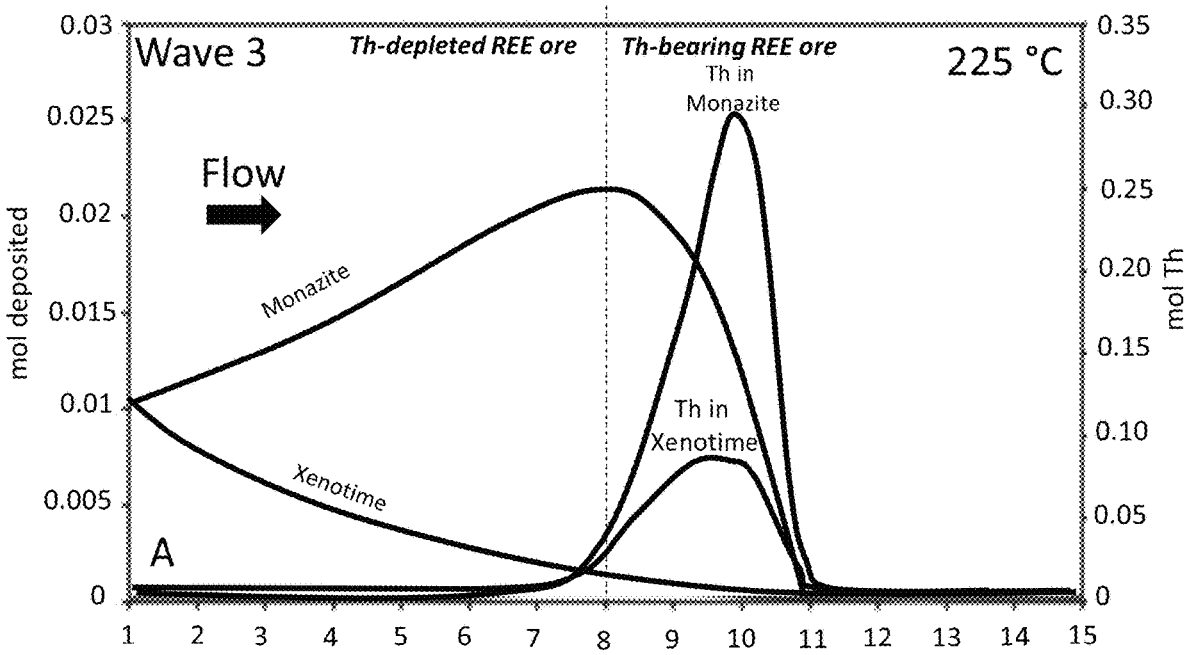
FIG. 4 illustrates results obtained from separating different REEs from one another and also from thorium (Th) using an apatite column at 225° C. (horizontal scale–formal distance along the column).

Moreover, in at least some examples, different REEs may be extracted along different regions of the flow-through container structure. For example, FIG. 4 illustrates results obtained from a hydrothermal process embodiment where an HREE was separated from an LREE and further was separated from Th using a flow-through container structure embodiment containing apatite, wherein the flow-through container structure embodiment was operated at a temperature of 225° C. With reference to FIG. 4, the horizontal axis represents the formal distance along the length of the flow-through container structure. As can be seen from FIG. 4, flushing the apatite-filled column with a fluid comprising the REEs and Th results in accumulating xenotime (an HREE-bearing phosphate) at the beginning of the flow-through container structure along the flow path (e.g., near the end of the flow-through container structure proximal to where the fluid is introduced), whereas monazite, an LREE-bearing material, is accumulated towards the middle region of the flow-through container structure along the flow path. Th-containing fractions are accumulated at the end of the flow-through container structure along the flow path (e.g., near the end of the flow-through container structure distal to where the fluid is introduced.

Figure 5:
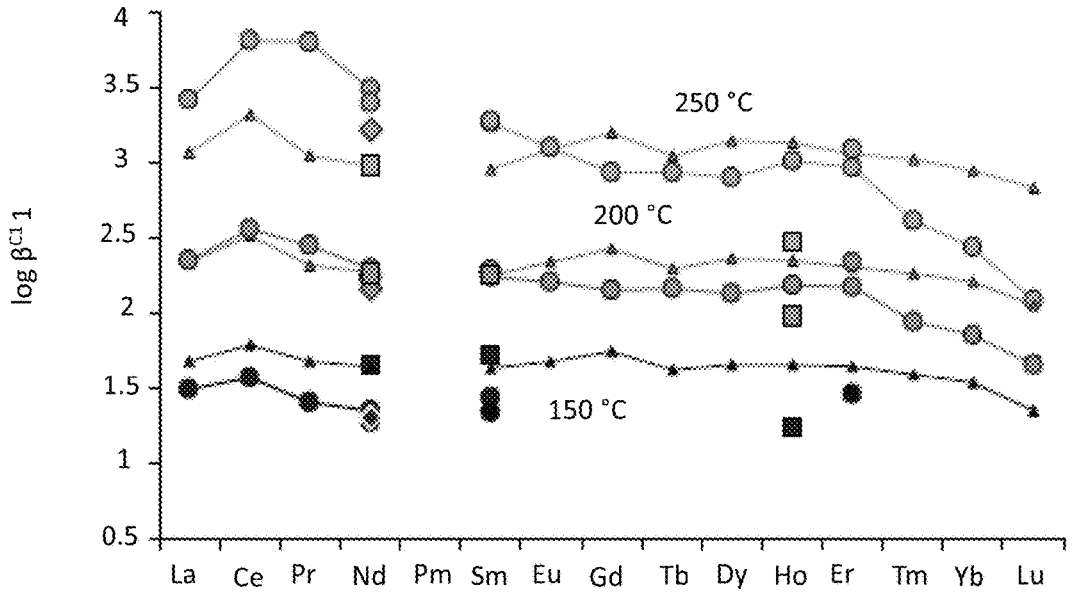
FIG. 5 illustrates differences aqueous complex stability of individual REEs at different temperatures.

In some embodiments, separation results discussed above can be achieved in view of the differences in the stability of aqueous complexes of individual REEs at elevated temperatures. For example, as can be seen in FIG. 5, different REEs can exhibit different stabilities as temperatures are increased, such as to temperatures of 150° C., 200° C., and 250° C. and thus this characteristic can facilitate separating the different REEs from one another. In contrast, many REE aqueous species within the lanthanide group of elements are nearly indistinguishable at ambient temperatures and thus hydrothermal process embodiments of the present disclosure can be used to facilitate separating such species.

Figure 6:
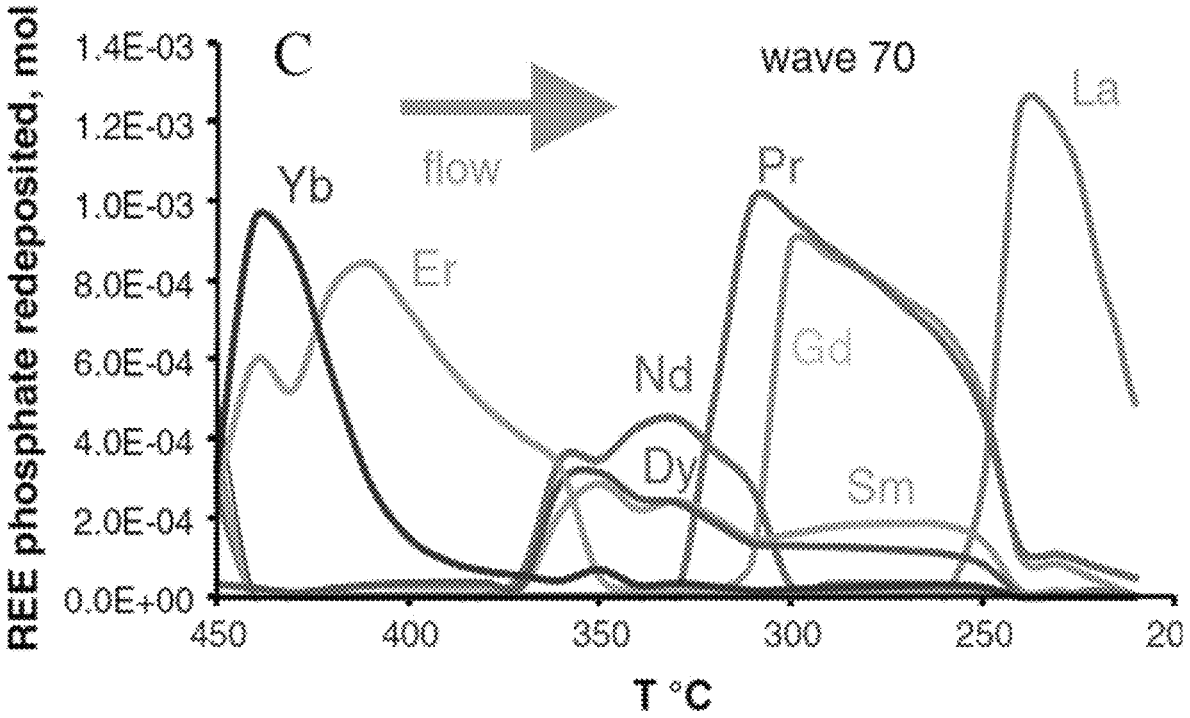
FIG. 6 is a representation of REE separation in a system embodiment in which REE stability in aqueous complexes is augmented by applying or exploiting a temperature gradient.

Another graphical representation of REE separation using a flow-through container structure and hydrothermal conditions described herein, such as where temperature is decreased from an elevated temperature of 450° C. to a lower elevated temperature of 200° C. is provided by FIG. 6. As can be seen from FIG. 6, at higher elevated temperatures (e.g., 450° C.), the region of the flow-through container structure proximal to fluid introduction is strongly enriched with heaviest REE, and the peaks of different REEs continuously replace one another along the column and as temperature is changed (e.g., lowered). In the embodiment giving rise to the results shown in FIG. 6, the lightest REE was isolated near the distal end of the flow-through container structure (relative to fluid introduction) and in some embodiments can be eluted from the flow-through container structure with the fluid. Thus hydrothermal process embodiments described herein can be used to selectively extract one or more particular REEs based on selective control of the elevated temperature of the environment surrounding the fluid introduced into the flow-through container structure (e.g., the temperature of the flow-through container structure or other container structure, the extractant material it contains, or the like).

Figure 7:
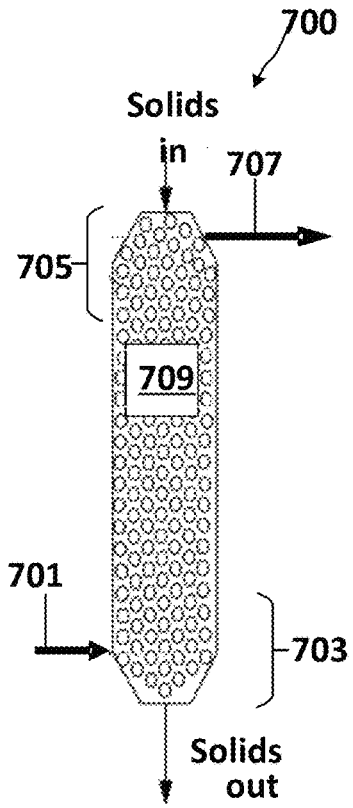
FIG. 7 is a schematic representation of a representative system embodiment comprising a moving bed reactor and an extractant material contained therein.

Additional system embodiments that can be used to facilitate REE extraction and separation also are described herein. In some embodiments, the system can comprise a moving bed reactor. An exemplary moving bed reactor system is illustrated in FIG. 7. With reference to FIG. 7, moving bed reactor 700 can be used to extract REEs from a fluid that comprises one or more REEs (represented by arrow 701). The fluid comprising the one or more REEs is introduced into moving bed reactor 700 such that it flows in a flow path direction that extends from bottom region 703 of the moving bed reactor to top region 705 of the moving bed reactor. For example, fluid comprising one or more REEs (represented by arrow 701) can be introduced into moving bed reactor 700 at bottom region 703 of the moving bed reactor and as it flows through the moving bed reactor, REEs can be extracted and/or separated, and then the effluent (represented by arrow 707), which is free of (or is substantially free of) the REEs, is expelled from top region 705 of the moving bed reactor. In some embodiments, light REEs can be present in the effluent. In at least some examples, the direction of fluid flow through moving bed reactor 700 may be opposite (or substantially opposite) to the direction of any gravitational force. Also, extractant material 709 can be introduced into moving bed reactor 700 at top region 705, and can move to bottom region 703 of the moving bed reactor, where the extractant material is removed from the moving bed reactor. Extractant material 709 may be continuously introduced into the moving bed reactor. As the extractant material 709 moves down through the moving bed reactor 700, negative ions (e.g., fluoride ions and/or phosphate ions) may react with one or more REEs present in the fluid introduced into the moving bed reactor moving up through the moving bed reactor 700, in a direction opposite to the flow direction of the extractant material 709. Such moving bed reactor embodiments can be used to extract and/or separate one or more REEs from a fluid introduced into the moving bed reactor and/or from other REEs present in the fluid. In at least some examples, light weight REEs may be isolated in regions close to a top region of the moving bed reactor (that is, a region that is distal to where the fluid comprising the REEs is introduced into the moving bed reactor) and heavier REEs may be isolated in regions closer to a bottom region of the moving bed reactor (that is, a region that is proximal to where the fluid comprising the REEs is introduced into the moving bed reactor). In some embodiments, heating coils or wraps can be included along the moving bed reactor 700 to heat the extractant material therein at an elevated temperature, such as described herein for hydrothermal process embodiments.

Figure 8:
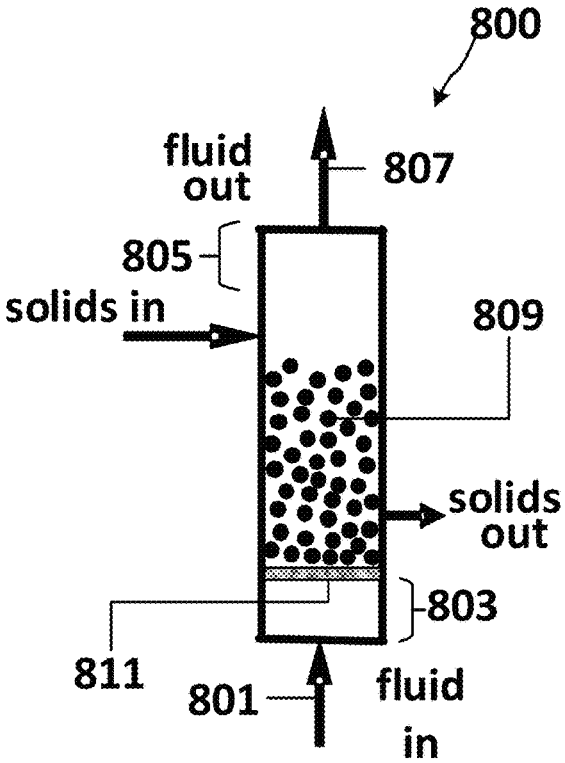
FIG. 8 is a schematic representation of a representative system embodiment comprising a fluidized bed reactor and an extractant material contained therein.

Another technique for extracting and separating REEs includes using a system comprising a fluidized bed reactor. An exemplary fluidized bed reactor is illustrated in FIG. 8 as fluidized bed reactor 800. In the fluidized bed reactor 800, fluid containing one or more REEs (represented by arrow 801) can be introduced into lower region 803 of the fluidized bed reactor and follows along a flow path that flows in a direction from the lower region to top region 805 of the fluidized bed reactor 800, where effluent fluid (illustrated as arrow 807) is removed from the fluidized bed reactor. In at least some examples, the flow of the fluid comprising the one or more REEs through the fluidized bed reactor 800 may be in a direction opposite (or substantially opposite) to that of gravity.

As the fluid comprising the one or more REEs moves through fluidized bed reactor 800, the fluid passes through extractant material 809. In contrast to certain moving bed reactor embodiments, such as moving bed reactor 700 illustrated in FIG. 7 (in which the extractant material 709 is added to and removed from the moving bed reactor 700 as fluid comprising one or more REEs flows through the moving bed reactor), the extractant material 809 is constantly present in fluidized bed reactor 800. The extractant material 809 in fluidized bed reactor 800 may be supported by a porous plate (e.g., porous plate 811 in FIG. 8), which also can be referred to as a "distributor." If a distributor is used, the fluid comprising one or more REEs may be forced through the distributor and thereafter up through the extractant material 809.

In yet additional embodiments, such as embodiments where lower fluid velocities are used, the extractant material 809 may remain in place as the fluid comprising one or more REEs passes through the voids in the extractant material 809. Such embodiments can be used as packed bed reactor embodiments. As fluid velocity is increased in such embodiments, the reactor will reach a stage where the force of the fluid comprising the one or more REEs on the extractant material 809 is enough to balance the weight of the extractant material 809, thereby providing incipient fluidization (which occurs at the minimum fluidization velocity). Once the minimum velocity is surpassed, the extractant material 809 begins to expand and swirl around. When this occurs, the reactor can function as a fluidized bed reactor embodiment. Depending on the operating conditions and properties of solid phase, various flow regimes can be observed in these reactor embodiments.

With further reference to FIG. 8, as the fluid comprising the one or more REEs flows through the extractant material 809, one or more REEs may be extracted from the fluid because it becomes bound to the extractant material 809. In at least some examples, the lightest REEs of the extracted REEs may band (or accumulate) near top region 805, and weights of extracted REEs increase gradually down the length of fluidized bed reactor 800 such that heavy extracted REEs are isolated in lower region 803 of the fluidized bed reactor. As a result, one may observe discrete separation bands/regions of REEs of different weights in fluidized bed reactor 800.

Figure 9:
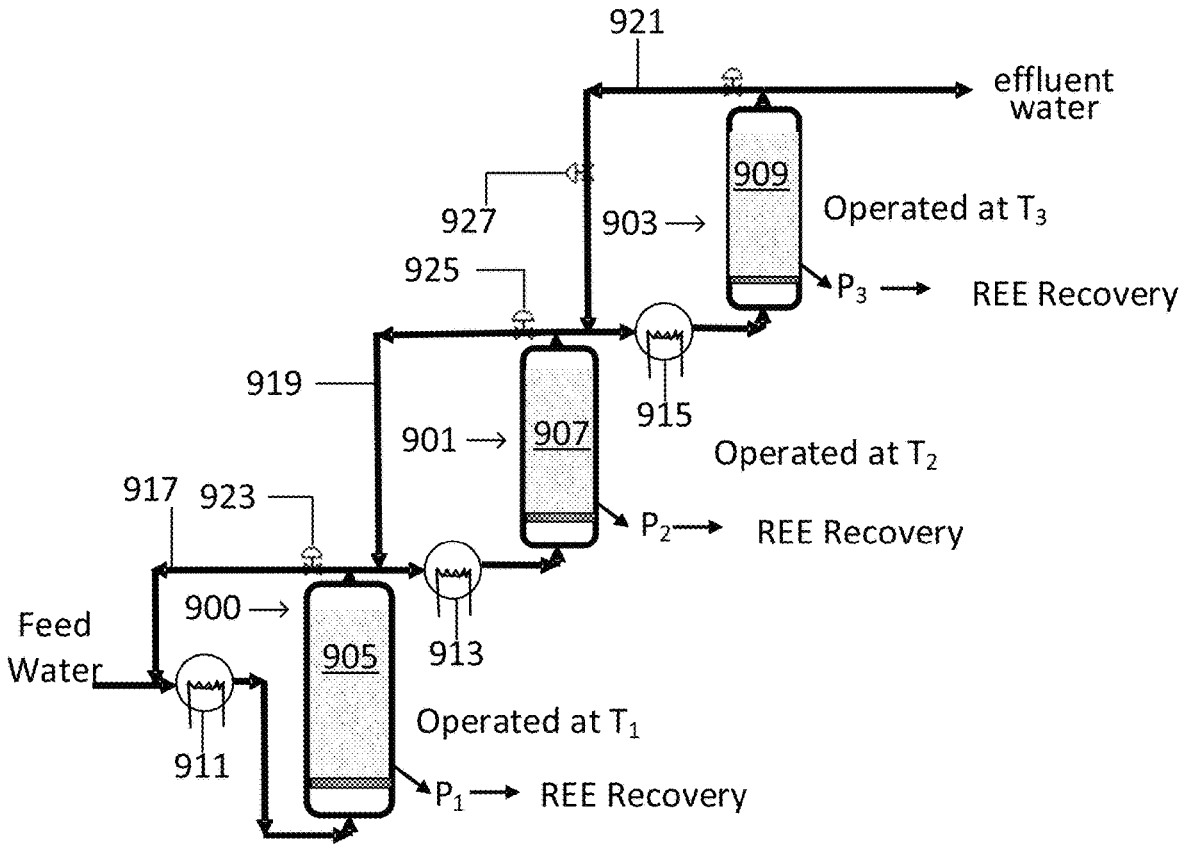
FIG. 9 is a schematic representation of a representative multi-stage system embodiment comprising a plurality of flow-through container structures and extractant materials, wherein each system can be operated at different temperatures and/or pressures.

A representative multi-stage system embodiment is illustrated schematically in FIG. 9. In multi-stage system embodiments, such as the exemplary embodiment illustrated in FIG. 9, extractant materials comprising different chemical compositions can be used in each system of the multi-stage system, or each system can be operated at different feed rates, and/or each system can be operated at different temperatures and/or pressures. FIG. 9 shows an exemplary embodiment where a plurality of fluidized bed reactor embodiments (e.g., fluidized bed reactors 900, 901, and 903) are combined in series and selected extractant materials (e.g., extractant materials 905, 907, and 909) are used in each different fluidized bed reactor and each fluidized bed reactor is heated at different temperatures ($T_1$, $T_2$, and $T_3$) to selectively extract and separate particular REE products ($P_1$, $P_2$, and $P_3$) at different stages. In some embodiments, the plurality and/or combinations of system embodiments can further comprise one or more heating elements to maintain and control temperatures, one or more heat exchanges to provide efficient energy utilization (e.g., heat exchangers 911, 913, and 915), one or more partial water recycling flow paths (e.g., flow paths 917, 919, and 921) to facilitate REE removal from the system embodiments, one or more assorted valves (e.g., valves 923, 925, and 927), one or more sensors, one or more controllers, and the like to regulate system operation.

III. Overview of Several Embodiments

Disclosed herein are embodiments of a system comprising: a flow-through container structure having a hollow interior, wherein the flow-through container structure is configured to allow a fluid comprising one or more rare earth elements (REEs) to flow through the flow-through container structure; an extractant material comprising phosphate ions, or fluoride ions, or a combination of phosphate ions and fluoride ions, wherein the extractant material is positioned within the hollow interior of the flow-through container structure; and a heating element associated with the flow-through container structure, wherein the heating element is configured to provide an elevated temperature environment.

In some embodiments, the system can further comprise a fluid comprising the one or more REEs and wherein the fluid is an acidic aqueous media.

In any or all of the above embodiments, the fluid is produced from an ore comprising the at least one REE, a concentrate comprising the at least one REE, fly ash comprising the at least one REE, or any combination thereof.

In any or all of the above embodiments, the flow-through container structure is a tubular container structure.

In any or all of the above embodiments, the tubular container structure is a high performance liquid chromatography (HPLC) column.

In any or all of the above embodiments, the flow-through container structure is a moving bed reactor or a fluidized bed reactor.

In any or all of the above embodiments, the extractant material is contained in the moving bed reactor but is configured to be free to move through the interior of the moving bed reactor in a same direction as gravitational forces.

In any or all of the above embodiments, the fluidized bed reactor further comprises a porous plate.

In any or all of the above embodiments, the extractant material comprises apatite, fluoroapatite, fluorite, or any combination thereof.

In any or all of the above embodiments, the heating component provides a temperature ranging from 225° C. to 450° C.

In any or all of the above embodiments, the heating element is electrically coupled to the flow-through container structure or wherein the heating element is physically associated with the flow-through container structure.

In any or all of the above embodiments, the heating element is a heating coil or a heating medium and wherein physically associating the heating element with the flow-through container structure comprises surrounding at least a portion of the flow-through container structure with the heating coil or immersing at least a portion of the flow-through container structure in the heating medium, or supplying heat using coils positioned within the flow-through container structure.

Also disclosed herein are embodiments of a method, comprising: providing a system comprising (i) a flow-through container structure having a hollow interior, wherein the flow-through container structure is configured to allow a fluid comprising one or more rare earth elements (REEs) to flow through the flow-through container structure; (ii) an extractant material comprising phosphate ions, or fluoride ions, or a combination of phosphate ions and fluoride ions, wherein the extractant material is positioned within the hollow interior of the flow-through container structure; and (iii) a heating element associated with the flow-through container structure, wherein the heating element is configured to provide an elevated temperature environment; introducing a fluid comprising one or more REEs into the system; heating the flow-through container structure, the extractant material, the fluid, or any combination thereof using the heating element; and passing the fluid through the flow-through container structure.

In some embodiments, the fluid is an acidic aqueous media.

In any or all of the above embodiments, the method further comprises producing the fluid from an ore comprising the at least one REE, a concentrate comprising the at least one REE, fly ash comprising the at least one REE, or any combination thereof.

In any or all of the above embodiments, the structure is a tubular container structure, a moving bed reactor, or a fluidized bed; and wherein the extractant material comprises apatite, fluoroapatite, fluorite, or any combination thereof.

In any or all of the above embodiments, the flow-through container structure, the extractant material, the fluid, or any combination thereof is heated at a temperature ranging from 225° C. to 450° C.

In any or all of the above embodiments, the temperature is gradually increased from 225° C. to 450° C. over a period of time, or wherein the temperature is gradually decreased from 450° C. to 225° C. over a period of time.

In any or all of the above embodiments, passing the fluid through the flow-through container structure comprises using gravitational forces to facilitate fluid flow or using a pump and/or back flow regulator to facilitate passing the fluid through the flow-through container structure.

In any or all of the above embodiments, the method further comprises modifying a flow rate of the fluid to facilitate REE extraction and/or establishing thermal gradients to facilitate REE extraction.

IV. Examples

Example 1

Fluorite ($CaF_2$) Filled Columns

Figure 10:
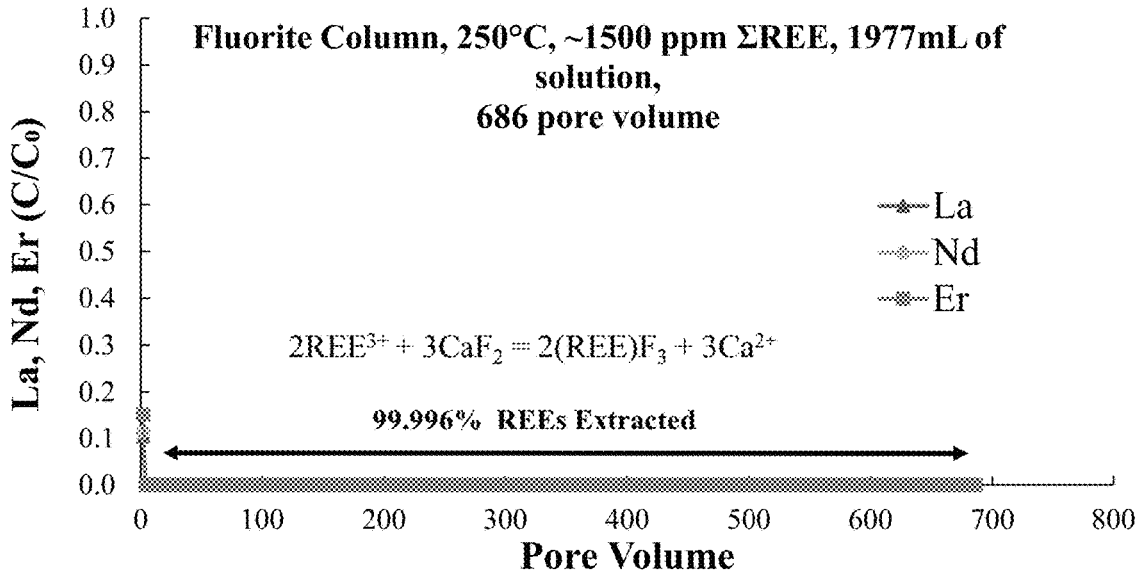
FIG. 10 is a graph showing results obtained from extracting REEs from a solution containing 500 ppm La (as $LaCl_3$), 500 ppm of Nd (as $NdCl_3$), 500 ppm of Er (as $ErCl_3$), and 2000 ppm of NaCl using a system embodiment comprising a column containing a fluorite material.

FIG. 10 show the extraction of REE from a solution containing 500 ppm La (as $LaCl_3$), 500 ppm of Nd (as $NdCl_3$), 500 ppm of Er (as $ErCl_3$), and 2000 ppm of NaCl in a fluorite ($CaF_2$)-filled column. The pH of the solution at 25° C. was 2. The column was 1.5 ft. long and was made out of titanium. The column was subjected to a furnace temperature of 250° C. A flow rate of 0.1 mL/minute was used. As illustrated in FIG. 10, nearly 100% extraction of REE was achieved.

Figure 11A:
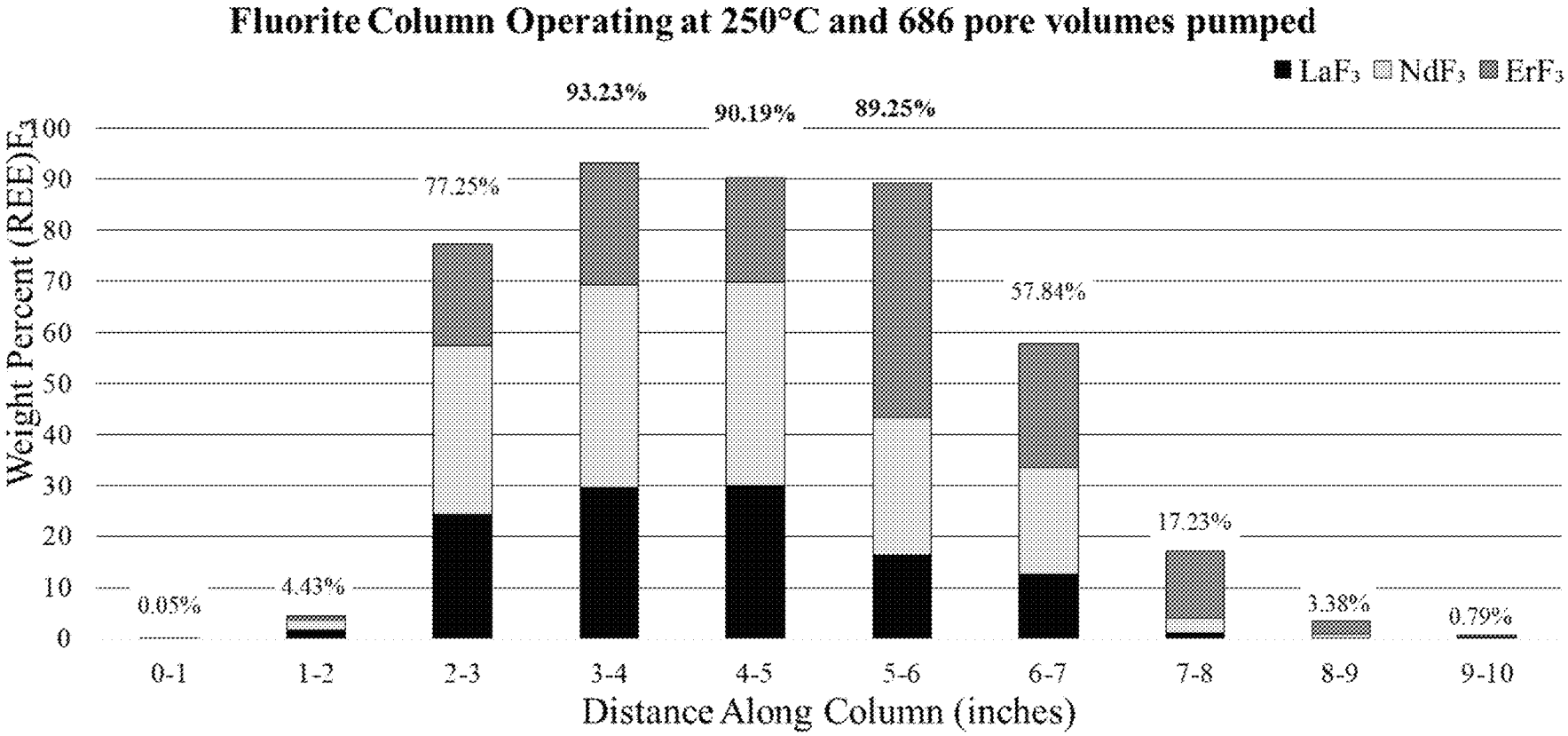
FIG. 11A is a graph showing the different compositions isolated on the column bed from the embodiment described in FIG. 10.
Figure 11B:
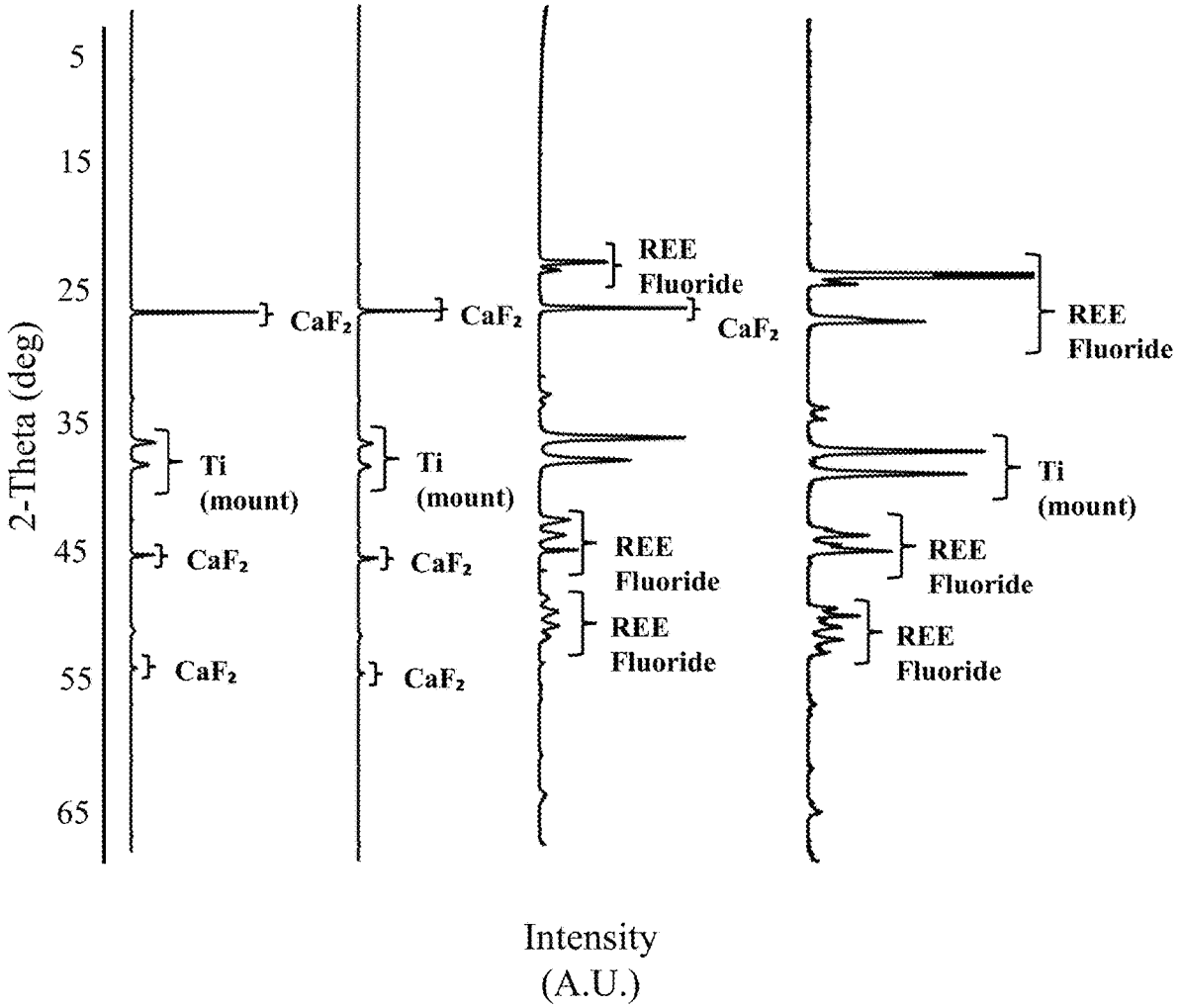
FIG. 11B shows XRD patterns collected from the samples of FIG. 11A.
Figure 11C:
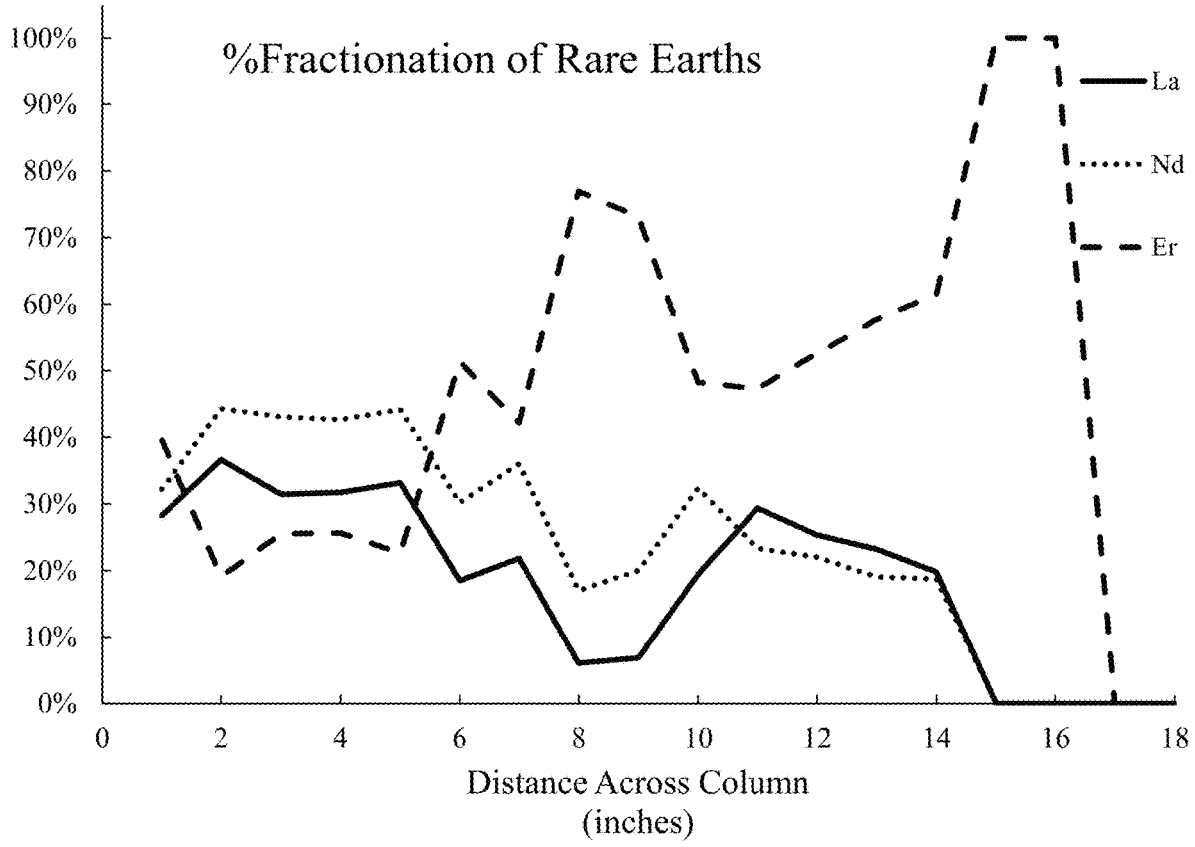
FIG. 11C shows REE fractionation observed along the fluorite-filled column according to the embodiment described in FIG. 10.

FIG. 11A illustrates the composition of a column bed corresponding to the experiment illustrated on FIG. 10. In the middle of the column, fluorite was nearly completely replaced by fluocerites (e.g., fluorides of La, Nd, and Er). FIG. 11B illustrates x-ray diffraction (XRD) patterns collected from the samples of FIG. 11A. FIG. 11C shows fractionation of REE observed along the column. As illustrated, the end of the column was heavily enriched by Er—a representative of HREE.

Example 2

Apatite ($Ca_5(PO_4)_3OH$)/Whitlockite ($Ca_3(PO_4)_2$) Filled Columns

Figure 12:
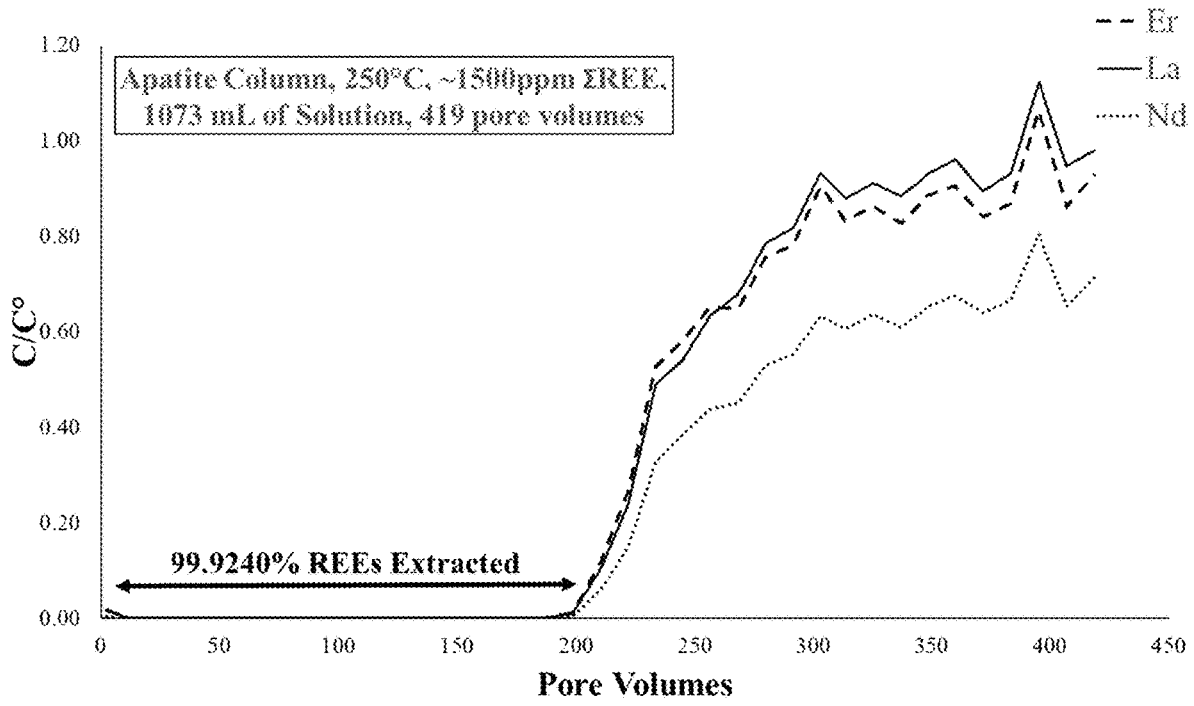
FIG. 12 is a graph showing results obtained from extracting REEs from a solution containing 500 ppm La (as $LaCl_3$), 500 ppm of Nd (as $NdCl_3$), 500 ppm of Er (as $ErCl_3$), and 2000 ppm of NaCl in a apatite/withlockite-filled column.

FIG. 12 illustrates extraction of REE from a solution containing 500 ppm La (as $LaCl_3$), 500 ppm of Nd (as $NdCl_3$), 500 ppm of Er (as $ErCl_3$), and 2000 ppm of NaCl in an apatite/withlockite-filled column. The pH of the solution at 25° C. was 2. The column was 2 ft. long and was made out of steel. The column was subjected to a furnace temperature of 250° C. A flow rate of 0.05 mL/minutes was used. As shown in FIG. 12, nearly 100% extraction of REE was achieved for up to 200 pore volumes pumped through the column. The following break-through of REE was accompanied by a decrease of Ca in the outflowing solution (illustrated in FIG. 13). Without being limited to a particular theory, it currently is believed that this may be caused by shielding of apatite (Ca and phosphate source) by dense layers of monazite, which blocked access of the solution to the phosphate source.

Figure 13:
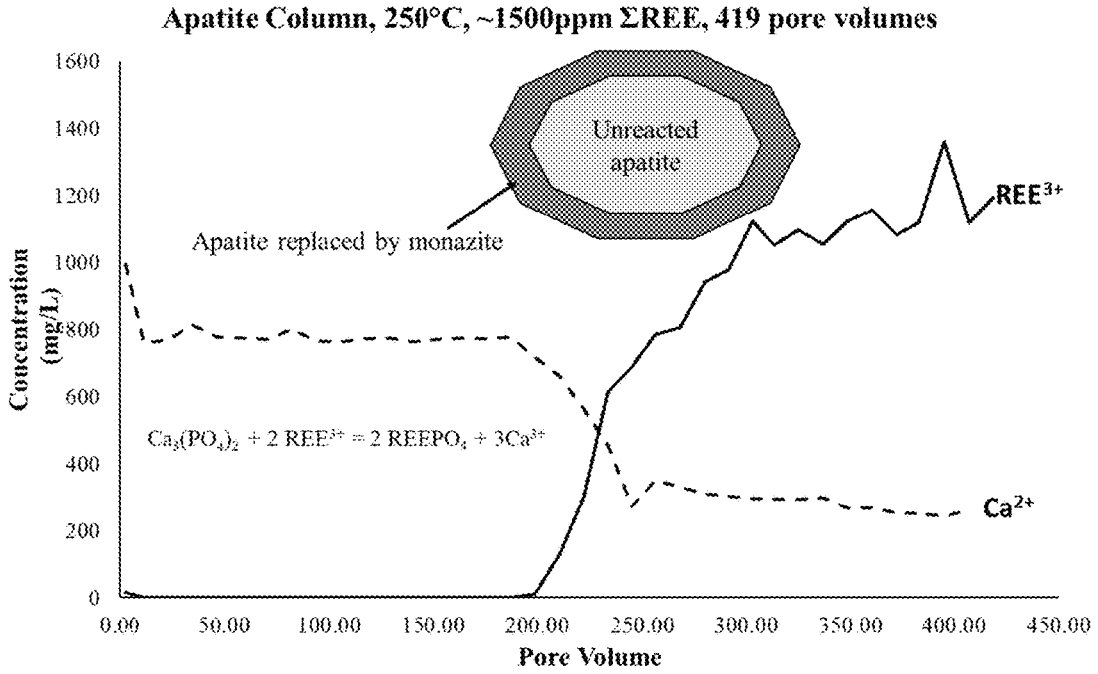
FIG. 13 illustrates results from a representative method embodiment where a break-through of REE was accompanied by a decrease in calcium (Ca) in the effluent solution exiting a system embodiment.
Figure 14A:
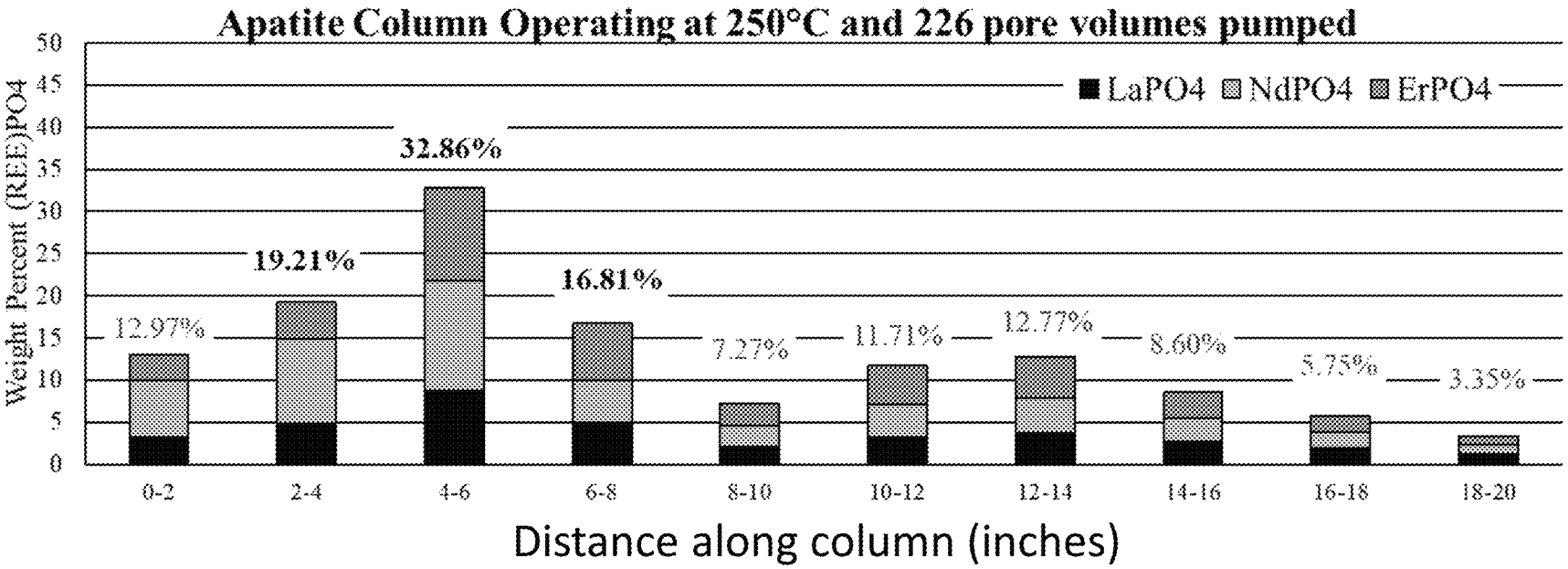
FIG. 14A is a graph showing the different compositions isolated on the column bed from the embodiment described in FIG. 12.
Figure 14B:
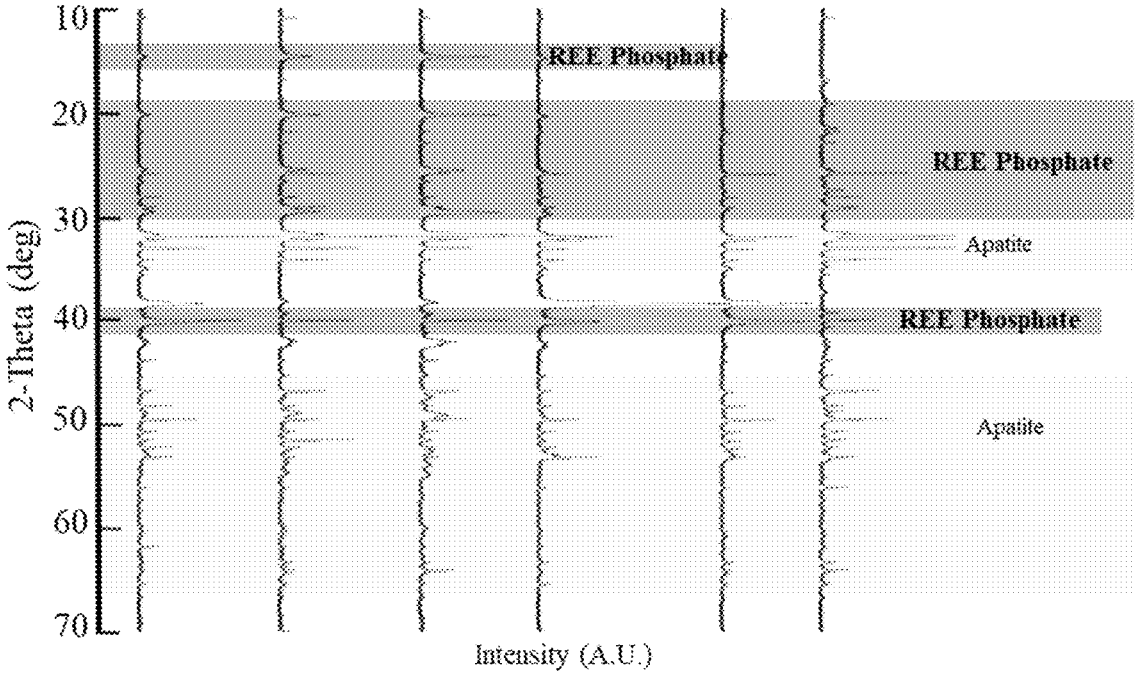
FIG. 14B illustrates XRD patterns collected from the samples of FIG. 14A.
Figure 14C:
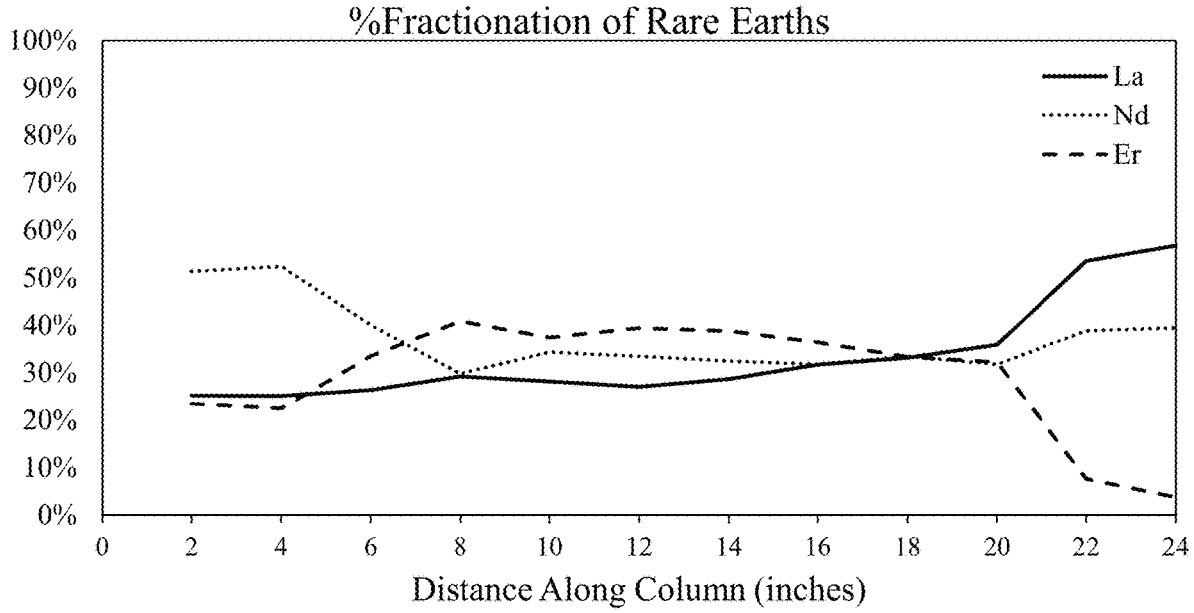
FIG. 14C shows REE fractionation observed along the apatite/withlockite-filled column according to the embodiment described in FIG. 12.

Similar to FIG. 11, FIGS. 14A-14C illustrates changes in the composition of the column bed determined in the experiments illustrated on FIG. 13. FIG. 14A shows the distribution of content of formed REE phosphates along the column, FIG. 14B illustrates the XRD patterns collected from the samples of FIG. 14A. FIG. 14C shows the degree of fractionation/separation observed in these experiments.

TABLE 1

Detailed elemental composition of apatite used as the extractant material.

| Element I.D. | % or PPM |
|---|---|
| $Na_2O$ % | 0.222 |
| MgO % | 0.07 |
| $Al_2O_3$ % | 0.196 |
| $SiO_2$ % | 9.1 |
| $P_2O_5$ % | 33.8 |
| CaO % | 54.7 |
| V ppm | 20 |
| Cr ppm | 179 |
| NiO | 0.004 |
| Ni ppm | 30 |
| Cu ppm | 15 |
| Sr ppm | 631 |
| Y ppm | 449 |
| Zr ppm | 150 |
| Pb ppm | 53 |
| La ppm | 2404.5 |
| Ce ppm | 5120.6 |
| Pr ppm | 452.0 |
| Sm ppm | 119.0 |
| Gd ppm | 138.7 |
| Nd ppm | 1594.7 |
| Er ppm | 82.201 |
| Th ppm | 2144.3 |
| U ppm | 71.2 |
| LOI % | 0.18 |
| Total % | 100.2 |

In view of the many possible embodiments to which the principles of the present disclosure may be applied, it should be recognized that the illustrated embodiments are only examples and should not be taken as limiting the scope of the present disclosure. Rather, the scope is defined by the following claims. We therefore claim as our invention all that comes within the scope and spirit of these claims.

We claim:

1. A method, comprising:

contacting a fluid comprising at least one rare earth element (REE) with an extractant material comprising phosphate ions, or fluoride ions, or a combination of phosphate ions and fluoride ions; and heating the extractant material and the fluid, wherein heating the extractant material and the fluid comprises heating the extractant material and the fluid at a temperature ranging from 100° C. to 450° C.; and gradually (i) increasing the temperature from 100° C. to a temperature as high as 450° C. over a period of time, or (ii) decreasing the temperature from 450° C. to a temperature as low as 100° C. over a period of time.

2. The method of claim 1, wherein the fluid is an acidic aqueous media.

3. The method of claim 1, further comprising producing the fluid from an ore comprising the at least one REE, a concentrate comprising the at least one REE, fly ash comprising the at least one REE, or any combination thereof.

4. The method of claim 1, wherein the extractant material comprises apatite, fluoroapatite, fluorite, or any combination thereof.

5. The method of claim 1, wherein contacting the fluid with the extractant material comprises (i) flowing the fluid over the extractant material, which is held in a stationary position; (ii) flowing the fluid and the extractant material in opposite directions; or (iii) flowing the fluid over particles of the extractant material at a velocity sufficient to levitate particles of the extractant material.

6. The method of claim 5, further comprising increasing or decreasing a flow rate of the fluid as it flows over the extractant material to facilitate REE extraction.

7. The method of claim 1, further comprising subsequently separating the at least one REE from the extractant material using a chemical, thermal, or mechanical treatment.

8. A method, comprising:

contacting a fluid comprising at least one rare earth element (REE) with an extractant material comprising phosphate ions, or fluoride ions, or a combination of phosphate ions and fluoride ions;

heating the extractant material and the fluid; and establishing thermal gradients to facilitate REE extraction.

9. The method of claim 8, wherein the fluid is an acidic aqueous media.

10. The method of claim 8, further comprising producing the fluid from an ore comprising the at least one REE, a concentrate comprising the at least one REE, fly ash comprising the at least one REE, or any combination thereof.

11. The method of claim 8, wherein the extractant material comprises apatite, fluoroapatite, fluorite, or any combination thereof.

12. The method of claim 8, wherein contacting the fluid with the extractant material comprises (i) flowing the fluid over the extractant material, which is held in a stationary position; (ii) flowing the fluid and the extractant material in opposite directions; or (iii) flowing the fluid over particles of the extractant material at a velocity sufficient to levitate particles of the extractant material.

13. The method of claim 12, further comprising increasing or decreasing a flow rate of the fluid as it flows over the extractant material to facilitate REE extraction.

14. The method of claim 8, further comprising subsequently separating the at least one REE from the extractant material using a chemical, thermal, or mechanical treatment.

* * * * *